US005232097A

United States Patent [19]

Tohkala

[11] Patent Number: 5,232,097

[45] Date of Patent: Aug. 3, 1993

[54] SCREENING METHOD AND APPARATUS

[75] Inventor: Antti Tohkala, Rauma, Finland

[73] Assignee: Sunds Defibrator Woodhandling Oy, Pori, Finland

[21] Appl. No.: 985,263

[22] Filed: Dec. 3, 1992

[30] Foreign Application Priority Data

Dec. 10, 1991 [FI] Finland ..... 915803

[51] Int. Cl.[5] ..... B07B 9/00

[52] U.S. Cl. ..... 209/234; 209/672; 209/673; 209/632

[58] Field of Search ..... 209/667, 672, 673, 235, 209/236, 242, 629, 632, 234

[56] References Cited

U.S. PATENT DOCUMENTS

| | | | |
|---|---|---|---|
| 1,899,292 | 2/1933 | Rienks | 209/632 |
| 4,209,097 | 6/1980 | Nordmark et al. | 209/673 X |
| 4,376,042 | 3/1983 | Brown | 209/672 X |
| 4,430,210 | 2/1984 | Tuuha | 209/672 X |
| 4,789,068 | 12/1988 | Gilmore | 209/234 X |
| 5,000,390 | 3/1991 | Marrs | 209/234 X |
| 5,058,751 | 10/1991 | Artiano | 209/673 |
| 5,078,274 | 1/1992 | Brown | 209/629 X |
| 5,109,988 | 5/1992 | Artiano | 209/673 X |
| 5,137,621 | 8/1992 | Brown | 209/234 |

OTHER PUBLICATIONS

Smith, Desmond, "The State of the Art in Chip Fines Screening", Tappi Journal, (Sep. 1989) pp. 143-149.

*Primary Examiner*—D. Glenn Dayoan

*Attorney, Agent, or Firm*—Burns, Doane, Swecker & Mathis

[57] ABSTRACT

The present invention concerns a screening method and apparatus for sorting wood chips into three categories, namely, accept chips, overthick and/or overlong chips requiring further processing and reject fines. The chips are fed onto a disc screen. A major portion of fines and a portion of accepts fall by gravity through clearances between the discs (1) of the disc screen and a portion of the chips travels over the disc screen. Screening of chips on the disc screen is cut short before all accept chips have fallen through the disc screen. Chips travelling over the discharge end of the disc screen are routed onto a roller screen (10), whereby the remaining portion of accepts can fall by gravity through the roller screen while overthick and/or overlong chunky chips are conveyed over the discharge end of the roller screen.

21 Claims, 2 Drawing Sheets

SCREENING METHOD AND APPARATUS

FIELD OF THE INVENTION

The present invention relates to a screening method for sorting wood chips into three categories, namely, accept chips, overthick and/or overlong chips requiring further processing, and reject fines, whereby the chips are routed to a disc screen having a plurality of rotating shafts, each of the shafts carrying a plurality of parallel adjacent discs spaced at a distance from each other, and the shafts being adapted in succession parallel so that the discs of each two adjacent shafts are adapted to intermesh, whereby a major portion of fines and a portion of accept chips can fall through the clearances between the adjacent disc surfaces in the disc screen while a portion of the chips travels over the disc screen. The invention also concerns an apparatus for sorting wood chips into three categories, namely, accept chips, overthick and/or overlong chips requiring further processing and reject fines, said apparatus comprising a disc screen having a plurality of rotating shafts, each of the shafts carrying a plurality of parallel adjacent discs spaced at a distance from each other, and the shafts being adapted in succession parallel so that the discs of each two adjacent shafts are adapted to intermesh.

BACKGROUND OF THE INVENTION

Screening apparatuses conventionally employed for screening chips are categorized into flat screens, disc screens and roller screens.

The purpose and benefits of screening are discussed in several books and patent publications related to the art. The task performed by screening apparatuses is to sort chips into three categories:

accept chips overlong and overthick chips suited to recycling reject portion or fines.

Disc screens known in the art are fast and effective in screening away fines, but handicapped by the problem that, in addition to passing accepts, they also let through a portion of overthick and overlong chips particularly at the end stage of the screen, whereby a major portion of accepts has already passed the screen. Moreover, a disc screen produces some fines and pins as a result of the aggressive shaping of the discs. Simply, the major benefit of a disc screen is its extremely fast fines screening capability.

The chief problem of a roller screen is that the fed blanket of chips at high throughput is carried over the rollers, whereby fines follow a long way along toward the end stage of the screen. Thus, a roller screen is principally capable of effectively screening away oversize chips, but accepts and fines are largely screened simultaneously.

Consequently, fines must be screened away from accept chips at the second partial screening stage. The dimensioning of this so-called fines screen stage and the amount of chips to be screened are dependent on the length of the screen section capable of screening away a major portion of fines contained in the main chips flow.

SUMMARY OF THE INVENTION

The method according to the invention is characterized in that processing of chips on the disc screen is cut short prior to attaining full screening of all accepts through the disc screen, and that the chips passing over the end stage of the disc screen is transferred onto a conventional roller screen having a plurality of rotating rollers spaced at a distance from each other, whereby the remaining portion of accepts falls through the roller screen and chunks comprised of overthick and/or overlong chips are conveyed over the discharge end of the roller screen. The apparatus according to the invention is characterized in that the discharge end of the disc screen in the apparatus is followed by a conventional roller screen comprised of a plurality of subsequent rotating rollers spaced at a distance from each other.

The method according to the invention achieves the combination of conventional screening apparatuses in such a manner that the most effective stages of different apparatuses and the properties thereof yielding the most advantageous final result are utilized.

The present invention makes it possible to optimize the results of the screening process as well as to minimize the apparatus employed for the screening process in terms of footprint and number of spare parts required, whereby both the power consumption and maintenance costs of the apparatus remain small in comparison with prior-art techniques.

In the method according to the invention, wood chips are first processed on a disc screen suited to fast removal of fines, after which the screening is contained on a roller screen suited to let accepts pass through but to convey oversize chips, that is overlong/overthick chips to further processing.

The method according to the invention offers the following benefits in the chip handling process:

only a portion of overlong and overthick chips can enter the portion of accepts, only a small portion of good chips lands in the portion routed to further processing, that is, rechipping, reject fines are separated quickly with only a small portion of accepts in its, thus permitting the use of a small-capacity fines screen.

DETAILED DESCRIPTION OF THE PREFERRED EMBODIMENT

Figure 1:
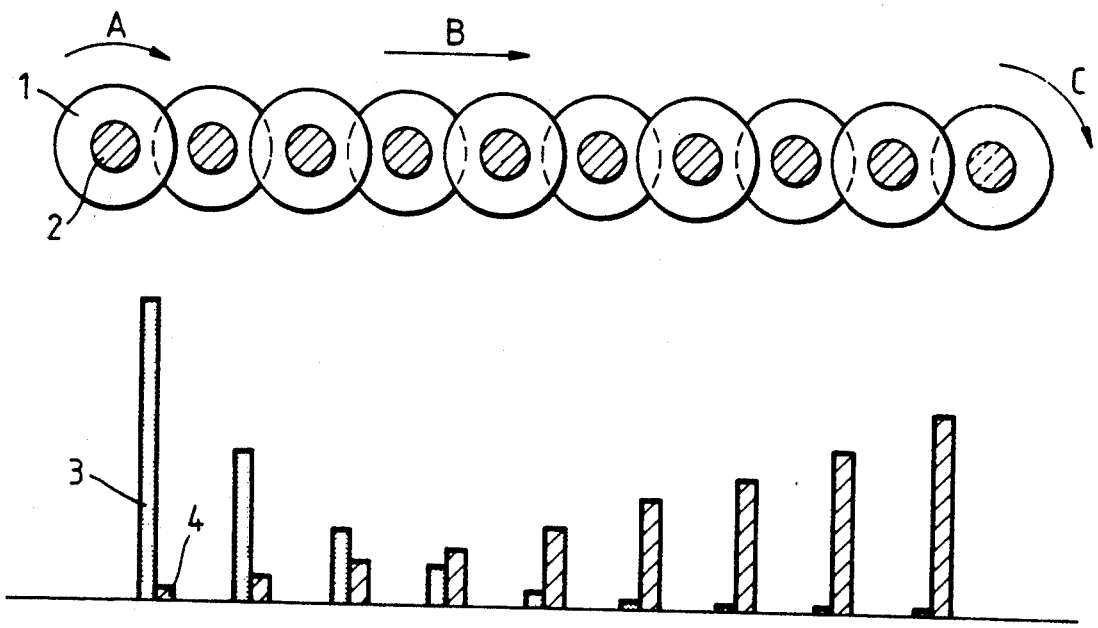
FIGS. 1 and 2 show diagrammatically a disc screen and a roller screen and the amount of chips falling through the screen.

According to FIG. 1 a disc screen is an apparatus comprised of screening discs 1 and shafts 2, the number of the discs being from 10 to 15. Each shaft 2 carries several parallel discs 1 spaced at a distance from each other. The shafts 2 are adapted in succession parallel so that the discs of two adjacent shafts intermesh. All the shafts 1 rotate in the same direction indicated by arrow A, while the flow of chips to be screened travels in the direction of arrow B. The clearances between the discs allow a portion of chips being screened to fall through.

The amount of fines passing through the screen is shown for each pair of shafts by columns 3 aligned under the disc screen in the diagram As is evident from FIG. 1, almost all fines are removed at the feed end of the disc screen. Further, the screen allows overthick and overlong chips indicated by columns 4 to pass. This portion of overthick and overlong chips is supposed to travel over the disc screen and exit at its discharge end as indicated by arrow C. The heights of columns 4 in FIG. 1 indicating the amount of chunky chips suited for further processing reveal, however, deficient function of the disc screen particularly at its discharge end. Thus, the final result of disc screening is unsatisfactory, and only a portion of overthick and overlong chunky chips can be removed.

Figure 2:
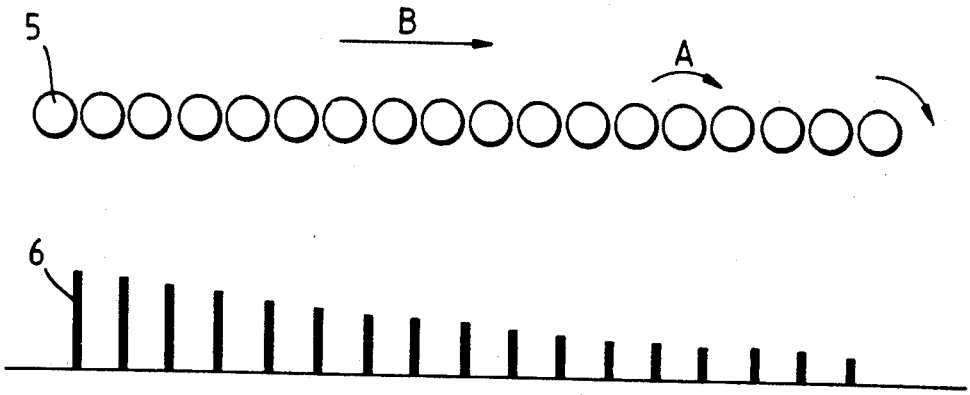

A roller screen illustrated in FIG. 2 offers an improved function in relation to the abovediscussed terms, but its chief disadvantage is a slow rate of fines removal. The screen is comprised of several rolls 5 in succession spaced at a distance from each other. The rotation of the rollers in the direction indicated by arrow A conveys the chips to be screened in the direction of arrow B, whereby a portion falls by gravity through the gaps between the rollers. The columns 6 in FIG. 2 indicating the amount of fines passing through each pair of rollers give a clear view of the slow function of the roller screen in separating fines. This requires that a substantial portion of the chips to be screened must be subjected to fines screening at the second stage, whereby this fines screen necessarily becomes large in size.

Such a roller screen system is disclosed in the FI patent application 890665. A further fact is that, as a substantial portion of fines can also pass through the end stage of the screen, accept chips will contain a large amount of fines as well.

According to tests performed, the chips flow travelling over the disc screen shown in FIG. 1 contains fines in the proportion of approx. 6% after passing over four gaps of shaft pairs, and of approx. 3% after five gaps of shaft pairs.

A roller screen of 25 rollers has also been tested at a certain input, whereby the removal rate of fines was found to be approx. 6 . . . 8% per shaft pair gap at the feed end, approx. 2 . . . 3% per shaft pair gap in the middle and approx. 0.3% per shaft pair gap at the discharge end. Simple calculations from these results indicate that only approx. 20% of fines are screened away on the latter half of a disc screen.

Figure 3:
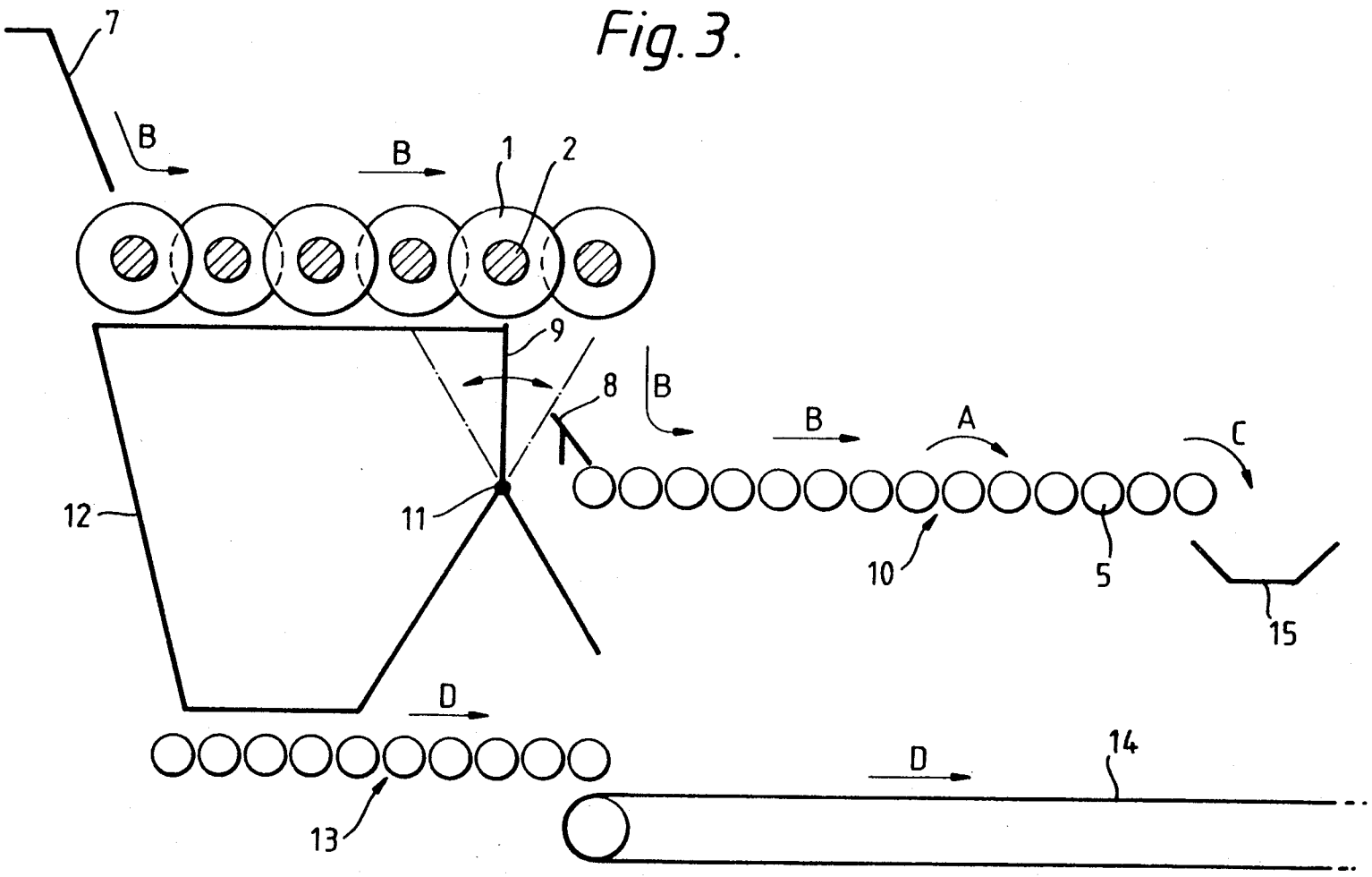
FIG. 3 shows a screening system according to the invention.

The screening method according to the invention illustrated in FIG. 3 is based on combining the advantageous properties of both a disc screen and a roller screen. The chips are fed onto the disc screen section along a tray 7 and screened on a disc screen of unconventionally short length comprising screen discs 1 and shafts 2. At least a third of the chips being screened can pass over to the discharge end of the disc screen, and the unscreened portion is routed along a flank 8 onto a roller screen 10. The amount of fines landing on a fines screen 13 can be adjusted by means of a deflection flap 9, rotatable about an axis 11 so that the vane can be set to direct chips falling through the disc screen at its the discharge end to either a bin 12 or a screened accepts band conveyor 14.

A major portion of fines is screened away in the short disc screen section of the screening apparatus, while only a small portion of accepts and a very small portion of overthick and overlong chips can fall through the screen. As the chips land on the roller screen section 10 shown in FIG. 3, almost all fines are already removed with only overthick and overlong chunky chips remaining to be conveyed to further rechipping. The portion fallen through the disc screen into the bin 12 contains both accept chips and fines. Therefore, a second roller screen 13 is placed below the bin. Fines can fall through gaps formed by the roller pairs of this screen, while accepts travel in the direction indicated by arrow D over the discharge end of the screen 13 onto the band conveyor 14, whereby this accepts flow can be combined with accepts fallen through the roller screen 10.

Accepts fall through the gaps between the rollers in the roller screen section 10 and land on the band conveyor 14. Almost all overlong and overthick chunky chips are discharged at the end of the roller screen section 10 in the direction indicated by arrow C and transferred by a band conveyor 15 to further processing. The band conveyor 14 transfers screened accepts from the fines screen 13, the deflection flap 9 and the roller screen section 10 in the direction indicated by arrow D.

I claim:

1. A screening method for sorting wood chips into three categories, namely, accept chips, overthick and/or overlong chips requiring further processing and reject fines, whereby the chips are routed to a disc screen having a plurality of rotating shafts (2), each of the shafts carrying a plurality of parallel adjacent discs (1) spaced at a distance from each other, and the shafts (2) being adapted in succession parallel so that the discs (1) of each two adjacent shafts are adapted to intermesh, whereby a major portion of fines and accept chips can fall through the clearances between the adjacent disc surfaces of the disc screen and a portion of the chips travels over the disc screen, characterized in that processing of chips on the disc screen is cut short prior to attaining full screening of all accepts through the disc screen, and that the chips passing over the end stage of the disc screen are routed onto a conventional roller screen (10) having a plurality of rotating rollers (5) spaced at a distance from each other, whereby the remaining portion of accepts falls through the roller screen (10) and overthick and/or overlong chunky chips are conveyed over the discharge end of the roller screen.

2. A method as defined in claim 1, characterized in that screening on the disc screen is cut short before $\frac{2}{3}$ of accepts has fallen through the disc screen.

3. A method as defined in claim 2, characterized in that screening on the disc screen is cut short before 50%, e advantageously before 25% of accepts has fallen through the disc screen.

4. A method as defined in claim 1, characterized in that screening on the disc screen is cut short when more than 90% of fines contained in the chips to be screened has fallen through the disc screen.

5. A method as defined in claim 1, characterized in that chips fallen through the disc screen are routed onto a fines screen (13).

6. A method as defined in claim 1, characterized in that the flow of chips fallen through the discharge end section of the disc screen to be controllably routed either on a fines screen (13) or into the flow of accepts.

7. A method as defined in claim 2, characterized in that chips fallen through the disc screen are routed onto a fines screen (13).

8. A method as defined in claim 3, characterized in that chips fallen through the disc screen are routed onto a fines screen (13).

9. A method as defined in claim 4, characterized in that chips fallen through the disc screen are routed onto a fines screen (13).

10. A method as defined in claim 2, characterized in the flow of chips fallen through the discharge end section of the disc screen to be controllably routed either on a fines screen (13) or into the flow of accepts.

11. A method as defined in claim 3, characterized in the flow of chips fallen through the discharge end section of the disc screen to be controllably routed either on a fines screen (13) or into the flow of accepts.

12. A method as defined in claim 4, characterized in the flow of chips fallen through the discharge end section of the disc screen to be controllably routed either on a fines screen (13) or into the flow of accepts.

13. A method as defined in claim 5, characterized in the flow of chips fallen through the discharge end section of the disc screen to be controllably routed either on a fines screen (13) or into the flow of accepts.

14. A method as defined in claim 7, characterized in the flow of chips fallen through the discharge end section of the disc screen to be controllably routed either on a fines screen (13) or into the flow of accepts.

15. A method as defined in claim 8, characterized in the flow of chips fallen through the discharge end section of the disc screen to be controllably routed either on a fines screen (13) or into the flow of accepts.

16. A method as defined in claim 9, characterized in the flow of chips fallen through the discharge end section of the disc screen to be controllably routed either on a fines screen (13) or into the flow of accepts.

17. An apparatus for sorting wood chips into three categories, namely, accept chips, overthick and/or overlong chips requiring further processing and reject fines, said apparatus comprising a disc screen having a plurality of rotating shafts (2), each of the shafts carrying a plurality of parallel adjacent discs (1) spaced at a distance from each other, and the shafts (2) being adapted in succession parallel so that the discs (1) of each two adjacent shafts are adapted to intermesh characterized in that the discharge end of the disc screen in the apparatus is followed by a conventional roller screen (10) comprised of a plurality of subsequent rotating rollers (5) spaced at a distance from each other, and that the shafts of the roller screen (10) are aligned parallel with the shafts (2) of the disc screen and are rotatable in the same direction as the rotation direction of the disc screen shafts.

18. An apparatus as defined in claim 17, characterized in that the underside of the discharge end section of the disc screen is provided with a rotatable flap (9) for controllably routing the flow of chips fallen through the discharge end section of the disc screen onto either a fines screen (13) placed below the disc screen or a conveyor (14) of screened accepts.

19. An apparatus as defined in claim 17, characterized in that the disc screen has maximally 8, advantageously maximally 6 successive shafts (1).

20. An apparatus as defined in claim 7, characterized in that the shafts of roller screen (10) are parallel to the shafts (2) of the disc screen and rotatable in the same rotation direction as the shafts of the disc screen.

21. An apparatus as defined in claim 8, characterized in that the shafts of roller screen (10) are parallel to the shafts (2) of the disc screen and rotatable in the same rotation direction as the shafts of the disc screen.

* * * * *